US007047779B2

(12) United States Patent
Kruger et al.

(10) Patent No.: US 7,047,779 B2
(45) Date of Patent: May 23, 2006

(54) CURVILINEAR PUNCH MOTION FOR DOUBLE-ACTION HOT STRETCH-FORMING

(75) Inventors: Gary A. Kruger, Troy, MI (US); Chongmin Kim, Bloomfield Township, MI (US); Mark G. Konopnicki, Rochester, MI (US)

(73) Assignee: General Motors Corporation, Detroit, MI (US)

( * ) Notice: Subject to any disclaimer, the term of this patent is extended or adjusted under 35 U.S.C. 154(b) by 298 days.

(21) Appl. No.: 10/755,488

(22) Filed: Jan. 12, 2004

(65) Prior Publication Data

US 2005/0150266 A1 Jul. 14, 2005

(51) Int. Cl.
*B21D 26/02* (2006.01)

(52) U.S. Cl. ..... 72/57
(58) Field of Classification Search ..... 72/452.8, 72/452.9, 452.2, 452.1, 709
See application file for complete search history.

(56) References Cited

U.S. PATENT DOCUMENTS

| | | | | |
|---|---|---|---|---|
| 5,904,064 | A * | 5/1999 | Higuchi | 72/452.9 |
| 6,196,040 | B1 * | 3/2001 | Matsuoka | 72/315 |
| 6,880,377 | B1 * | 4/2005 | Kim et al. | 72/57 |
| 6,910,358 | B1 * | 6/2005 | Schroth | 72/57 |

* cited by examiner

*Primary Examiner*—Derris H. Banks
*Assistant Examiner*—Debra Wolfe
(74) *Attorney, Agent, or Firm*—Kathryn A. Marra

(57) ABSTRACT

A method for forming sheet metal articles, such as automotive body panels, having complex curvatures. Opposing, complementary, pre-form and finish-form tools are used in a single press. A sheet of hot blow-formable sheet metal alloy, heated to a forming temperature, is placed between the tools. The pre-forming tool is lowered to a first stage closed position thereby trapping edges of the sheet between binder surfaces of the tools. The sheet is first stretched against the pre-form tool using pressurized gas to form a pre-form that undergoes most of the metal stretching required for the final part shape. Then the finish-form tool is pivotably advanced into a second stage closed position. The pre-form is displaced away from the pre-form tool and hot plastically formed against the opposing finish-form tool with pressurized gas to obtain the final sheet metal part shape. The finish-form tool is then pivotably retracted so as to avoid die lock or part interference conditions.

11 Claims, 2 Drawing Sheets

CURVILINEAR PUNCH MOTION FOR DOUBLE-ACTION HOT STRETCH-FORMING

TECHNICAL FIELD

The present invention generally pertains to hot-gas blow-forming of metal alloy sheet blanks into articles of complex curvature such as automotive body panels. More specifically, this invention pertains to hot blow-forming of a sheet metal blank with double-action tooling having a first, pre-form stage and a second, finish-form stage, wherein a form tool is movable along a curvilinear path so as to enable complex part geometry to be formed and extracted from the tooling while avoiding a die lock condition.

BACKGROUND OF THE INVENTION

Sheet metal articles can be made by hot stretch-forming processes that use complementary forming tools in a press under the pressure of a working gas to stretch-form a preheated sheet metal blank against forming surfaces on the forming tools. Such processes are particularly applicable to forming sheet metal into products of complex three-dimensional curvature such as automobile body panels.

In sheet metal hot blow forming processes, a hydraulic press is often used to support and move opposing forming tools that form a flat, pre-heated sheet metal blank into a three-dimensional contoured component. The hydraulic press is also preferred in order to provide balancing forces to oppose the high fluid pressures that build up between the forming tools. Hydraulic presses for shaping large parts typically open and close along a vertical axis. A vertically oriented hydraulic press, thus, has a lower platen for supporting one of the forming tools, often a punch or male finish-form tool, and an upper platen for carrying a complementary, opposing forming tool with a concave cavity, typically a female pre-form tool. The forming tools may be individually heated to maintain a suitable forming temperature for the sheet metal blank.

With hot blow forming processes, as well as with more conventional mechanical stamping processes, an engineer in charge of designing a manufacturing process will often choose a two-stage, two-station forming operation if the shape of the final body panel is impossible to form in a single stage. Such a two-stage process involves a first, pre-form stage and a second, finish-form stage that, together, minimize forming time and divide the total amount of material elongation to minimize the severity of panel deformation to yield a high-quality body panel. If, however, manufacturing economics dictate use of only a single station, then the engineer will often use double-action tooling. To operate such double-action tooling, the press can be a double-action press, wherein a secondary action of the press is generally used to clamp a sheet blank and perform first-stage forming.

In double-action hot stretch-forming, the sheet metal blank is inserted between the forming tools while in their open position and the press moves the forming tools from the open position to a first stage pre-forming position. Here, the edges of the blank are gripped between opposed binder surfaces of the opposed forming tools and gas pressure is applied to one side of the blank so that a central part of the blank is stretched against a pre-forming surface of the pre-form tool. Then, the opposing finish-form tool is moved closer to the now pre-formed blank in a second stage forming position. Gas pressure is now applied to an opposite side of the blank so that the central part of the blank is stretched against a finish-forming surface of the finish-form tool to complete the shaping of the blank. The press then opens for removal of the formed component and insertion of a new blank.

Hot stretch-forming of certain automobile body panels, however, poses unique challenges for tooling designers. For example, a deck lid, which, when mounted to an automobile, has a generally horizontal surface for covering a top of an automobile trunk and has a generally vertical surface for defining a rear end of the trunk. Both surfaces usually have complex curved shapes or features, such as at the corners thereof or deep pockets in the vertical surface for license plate or stop lamp recesses. One challenge is that such complex features are not amenable to the traditional vertical motion of the press and forming tools, because the complex features are disposed at a negative draft angle with respect to the vertical axis of the press motion. Accordingly, there exists a die lock condition between the finish-form tool and the finish-form blank. In other words, after second stage forming, the finish-form tool cannot be vertically retracted away from the finish-form blank, or vice-versa, without binding or interference between the complex features on the finish-form tool and the complex features of the pre-form blank.

Thus, there is a need for hot stretch-forming tooling designs that better accommodate part features disposed at a negative draft angle to avoid die-lock conditions.

SUMMARY OF THE INVENTION

The present invention meets the above-mentioned needs by providing an improved method of forming a sheet metal article. The method is particularly applicable to forming sheet metal into a stretch-formed product of complex three-dimensional curvatures with recessed, pocket-like, regions of high elongation. For example, the invention is applicable to the forming of automotive vehicle body panels.

In general, this invention is a method of using complementary, internally or externally heated, double-action forming tools in a single press and the pressure of a working gas to form a superplastically or quick plastically formable metal alloy sheet metal blank into a sheet metal product of complex shape. In a first stage, the sheet metal blank is given a pre-form shape involving substantial elongation of the sheet. In a second stage, the pre-form is then shaped into the final product.

Panels of complex shape can be formed in a single press using usually self-heated, complementary, but not mating, forming tools in the two stage forming process. Preferably, a concave or pre-form tool defines a generally concave cavity and an opposing punch or finish-form tool has a generally convex punch surface. The blank is inserted between the forming tools with a front side facing the pre-form tool and a back side of the blank engaging the finish form surface of the finish-form tool. The pre-form tool is shaped to accomplish a major portion of the stretching and elongation of the sheet. The finish-form tool completes bends and recessed corners and defines the final shape of the sheet metal produced in this forming operation. But, preferably, most of the metal stretching is accomplished in the pre-form step.

In accordance with an aspect of the present invention, the forming tools are in opposing relationship and movable from an open position for insertion of a sheet metal blank therebetween. The blank is externally preheated to its forming temperature or heated by radiation and conduction from the forming tool surfaces. In the pre-form stage of the process, the forming tools are moved to a first stage forming position in which the edges of the blank are gripped between binder surfaces of the forming tools. Then pressure of a suitable working gas, such as air or nitrogen, is applied to one side of the sheet blank to push and stretch the sheet against a pre-form tool surface of the pre-form tool. Alternatively, the pre-form stage of the process may be accomplished by mechanically imparting a pre-form shape to the sheet metal blank by mechanical stretching. Accordingly, the punch is moved toward the concave tool so as to stretch the sheet metal blank thereover.

In a second stage of the process, the opposing finish-form tool is then moved closer to the pre-formed sheet in accordance with a curvilinear path. Gas pressure is then applied to the opposite side of the blank to force it against the finish-form tool to complete the shaping of the sheet metal part. The press is then opened, the finish-form tool retracted in accord with the curvilinear path, and the formed part removed to accommodate insertion of a new blank.

As discussed previously, some part and finish-form tooling geometries pose a negative draft angle condition whereby it is impossible to vertically separate the part from the finish-form tooling without damage to the part after the part has been formed against the finish-form tooling. Such a die lock condition may be remedied by providing a finish-form tool that can be retracted in accordance with a path that is not necessarily straight, nor vertical, but rather is curvilinear. Accordingly, the finish-form tool is pivotably mounted about a fixed pivot axis, such that the finish-form tool may separate from the part in accordance with the negative draft angle to avoid the die lock condition therebetween.

This two stage forming process enables parts with complex curvatures to be formed in a single press using a double-action forming tool, wherein die lock conditions and attendant part damage are avoided. Other objects and advantages of the invention will be understood from a detailed description of a preferred embodiment which follows.

BRIEF DESCRIPTION OF THE DRAWINGS

These and other features and advantages of the invention will become apparent upon reading the detailed description in combination with the accompanying drawings, in which.

DESCRIPTION OF THE PREFERRED EMBODIMENT

In general, the present invention has application in two-stage stretch-forming of a heated sheet metal workpiece in a process where pressurized air or nitrogen is applied first to one side of the workpiece and then the other side to first stretch it against a heated pre-form tool and then against a heated finish-form tool.

Articles of complex shape such as automobile body panels can be made by such a practice using suitable high elongation alloys. For purposes of illustration the practice of this invention will be described in the super or quick plastic forming of fine grained, superplastically formable AA5083 sheet material about 1.5 mm in thickness. Typically, superplastic metal alloy blanks are processed to be about 0.7 to 3 mm in thickness. The aluminum alloy sheet metal blank will have been produced by a combination of hot rolling and cold rolling to a desired sheet thickness. The cold worked sheet is subjected to a static thermal re-crystallization operation to produce a suitable fine grained microstructure for superplastic or quick plastic forming of the sheet at an elevated temperature of, for example, 925° F. or 850° F., respectively. The sheet may also have at least one surface that has a high quality finish acceptable as an external visible surface of an assembled vehicle. Of course, the quality of such a sheet metal blank surface must be preserved throughout panel forming operations. When a forming analysis of the part indicates to the manufacturing engineers that the part cannot be formed in one stretching operation without producing surface folds or tears, use of the subject process may be imperative. Below, suitable press and tooling apparatus will be described for the practice of a preferred embodiment of the method of this invention.

In general, FIGS. 1 through 4 are schematic elevational illustrations in cross section of press platens and two complementary, but not mating, forming tools useful in a preferred embodiment of the invention, which illustrate the forming of an automotive body closure panel such as a deck lid outer panel.

Figure 1:
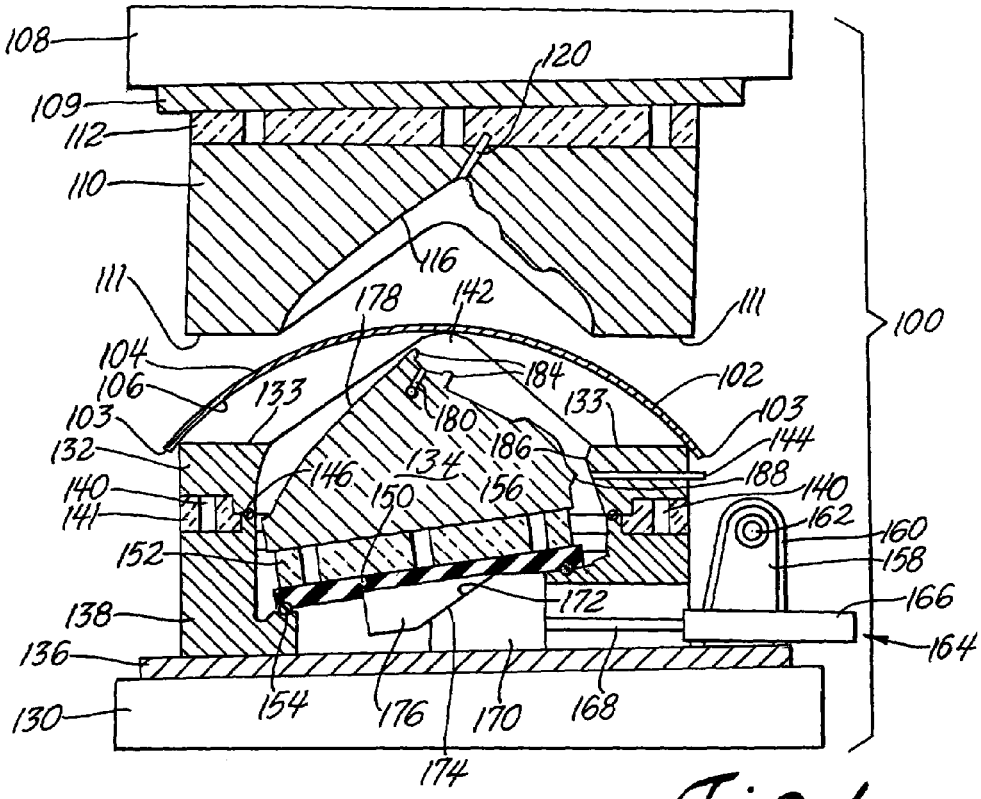
FIG. 1 is an elevational view in cross section of a press and tooling assembly having an upper pre-form tool and a lower pivotable finish-form tool with a sheet metal blank draped over a binder ring, wherein the forming tools are open for blank loading.

Referring to FIG. 1, the press and tooling assembly is indicated generally and schematically at 100 and is shown in an open position prior to pre-forming of a sheet metal blank 102. Blank 102 is shown in cross section in its pre-form position, and has a first side or upper surface 104 and a second side or lower surface 106.

The press and tooling combination 100 comprises an upper press platen 108 (the full press structure and hydraulic actuating mechanisms are conventional and not shown to reduce the complexity of the illustration). In accordance with well known mechanisms and techniques, there is securely attached to the upper press platen 108, a base plate 109 and a concave or pre-form tool 110 which is generally concave in configuration. The pre-form tool 110 may also be known as an upper female die, and the like. An insulation layer 112 thermally isolates pre-form tool 110 from the base plate 109 and upper platen 108. The upper base plate 109 may be cooled, such as by passing water through cooling passages therein, to prevent excessive heating of the upper platen 108. Similarly, the sides of the pre-form tool 110 may be wrapped in insulation layers (not shown) if desired. The pre-form tool 110 includes a pre-form surface 116 for use in shaping the blank 102. The pre-form surface defines a pre-form part geometry or configuration for the blank 102.

In accordance with known Quick-Plastic-Forming (QPF) techniques, the pre-form tool 110 is internally heated and it is thermally insulated from the upper press structure. Thus, pre-form tool 110 may include a plurality of heating elements (not shown) distributed therein for maintaining the tool 110 and surface 116 at a temperature suitable for forming of the AA5083 sheet material. An illustrative pre-form tool temperature for this magnesium containing aluminum alloy is, for example, 500° C. Heating elements are suitably commercially available electrical resistance heaters that are connected to suitable available electric power supply and electrical control units (not shown). While the specific heating elements may be of like construction and function, it is often preferred to connect them for electrical control purposes in several different control zones. It is preferred to closely control the temperature of pre-form tool 110 and pre-form surface 116 at a specified uniform temperature.

The pre-form tool 110 also includes a gas port 120 for admitting a working gas under pressure for a forming operation to be described below. Air or nitrogen is typically used as the working gas. The working gas is vented through gas port 120, or other venting port, when the forming operation is completed.

A lower press platen 130 carries a binder ring 132 and a punch or finish-form tool 134. The punch tool 134 may also be known as a male finish-form die, and the like. Lying on lower press platen 130 is a base plate 136 that supports a water cooled support structure 138 for binder ring 132. Unlike the upper base plate 109, the lower base plate 136 is not provided with cooling water passages, because the binder ring support structure 138 is already water cooled. The support structure 138 carries an insulation layer 141 and cylindrical columns 140 for supporting the binder ring 132. The binder ring 132 may be enclosed by an insulation ring (not shown). The binder ring 132 preferably contains heating elements (not shown). The finish-form tool 134 likewise may contain heating elements (not shown) for maintaining the finish-form tool 134 at the specified forming temperature of the sheet metal blank 102. In the finish-forming of the AA5083 pre-form, finish-form tool 134 is suitably maintained at a uniform temperature of about 440° C.

The sheet metal blank 102 is preferably preheated, externally of the press, and initially positioned over raised side portions 142 of the binder ring 132 when the press/tool assembly 100 is in its open position. Thus, the hot flexible blank 102 is draped over the binder ring 132 and above the finish-form tool 134. When the press is closed for pre-forming, or first stage forming, edges 103 of the draped sheet blank 102 become gripped between flat binder surfaces 111 of the pre-form tool 110 and flat binder surfaces 133 of the binder ring 132. The edges 103 of the blank 102 remain gripped between the pre-form tool 110 and the binder ring 132 throughout the two stage forming process and until the press is opened for removal of the formed part.

A gas port 144 extends through the binder ring 132 and permits the introduction of a working gas against the back side 106 of the sheet blank 102 during the pre-form step as will be described below. A sealing ring 146 is disposed between the binder ring 132 and the support 138 to seal the working gas within the press and tool assembly 100 during the pre-form step as seen in FIG. 1.

With the preheated, flat sheet metal blank 102 loaded in the open press/tool assembly 100, the forming process proceeds as follows.

Figure 2:
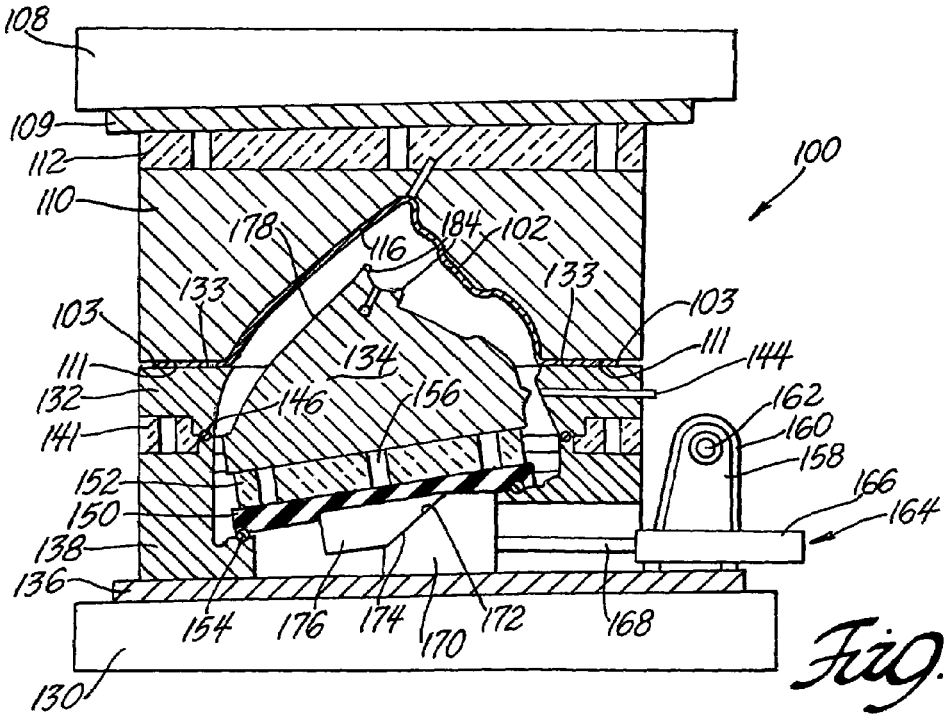
FIG. 2 is an elevational view in cross section of the press and tooling assembly of FIG. 1, wherein the pre-form tool has been lowered into a first stage forming position and the sheet metal blank has been formed against the pre-form tool.

Referring now to FIG. 2, the upper press platen 108 and pre-form tool 110 assembly is now moved toward and against the binder ring 132 into a first stage closed position. Relative movement of upper platen 108 and lower platen 130 closes the press and tool assembly 100 to the FIG. 2 position. The pre-form tool 110 is now positioned closer to the punch tool 134. In this closed position of the press and tool assembly 100, the pre-form tool 110 and binder ring 132 tightly secure the periphery or edges 103 of the sheet metal blank 102 between the opposed binder surfaces 111, 133. The secured blank 102 thus closes the press space around the finish-form tool 134 so that working gas pressure can be maintained against lower side 106 of blank 102. There is an additional sealing feature in the press/tool assembly 100 which is described below.

In accord with one preferred aspect of the pre-form stage of the present invention, a working gas under suitable pressure is introduced through gas port 144 so that gas pressure is applied to the lower side 106 of blank 102. Air that is trapped between the blank 102 and the cavity surface 116 is vented through a multitude of holes (not shown) in the cavity surface 116 that are fluidically connected to the gas port 120. The pressure of the working gas forces the preheated blank 102 against the cavity surface 116 and stretches or balloons it into desired compliance with the pre-form tool pre-form shaping surface 116. The preheat softened blank 102 and the relatively high temperature of the internally heated tools 110, 134 permit the blank 102 to be stretched at a gas pressure and strain rate suitable for practical and efficient forming cycles.

The air pressure is suitably applied in appropriate increasing increments as described, for example, in the Rashid et al. U.S. Pat. No. 6,253,588, Quick Plastic Forming of Aluminum Alloy Sheet Metal, which is incorporated by reference herein. Within a short period (e.g., 20 to 100 seconds) the heated blank 102 has assumed the shape of the pre-form tool 110 as illustrated in FIG. 2. When the pre-form stretching and shaping of the blank 102 has been completed, the working gas is released through gas port 144 or other venting port. In general, much of the metal stretching required to produce the final part shape is introduced in the pre-form step. Final bending and corner details and the like are accomplished in the second forming stage, described below in reference to FIG. 3.

As shown in FIGS. 1 and 2, punch tool 134 is carried by the lower press platen 130 but is movable separately therefrom. The punch tool 134 is carried on a mounting plate 150 with an insulation layer 152 positioned therebetween. The plate 150 rests on the cooled support structure 138, with an O-ring or seal 154 mounted in a groove therein to provide a gas seal for the above described pre-form operation.

The plate 150 is connected to the finish-form tool 134 by rods, posts, or cylinders 156 which extend through insulation 152. The finish-form tool 134 is pivotably mounted to the lower platen 130 by means of a swing arm 158 that is pivotably supported by a stanchion 160 by a pivot point or pin 162. The stanchion 160 is preferably fixed to the lower base plate 136. Preferably, there are two laterally opposed swing arms 158 for balanced support of the finish-form tool 134.

The finish-form tool 134 and swing arm 158 are pivotably actuated by means of a cylinder and cam device 164 that is positioned preferably between the laterally opposed swing arms 158. The cylinder and cam device 164 includes a cylinder 166 that may be mounted to the lower base plate 136 in any manner desired. The cylinder 166 may be hydraulic, electric, pneumatic, or the like. A piston 168 mounts within the cylinder 166 and is fastened at a distal end thereof to a drive cam 170. Accordingly, the cylinder 166 and piston 168 are actuatable to traverse the drive cam 170 back and forth. The drive cam 170 has a cam surface 172 that cooperates with a cam surface 174 on a driven cam 176 that is mounted to the mounting plate 150 under the finish-form tool 134. Therefore, the finish-form tool 134 may be pivoted about the pivot pin 162 when the cylinder 166 is activated to drive the piston 168 and drive cam 170 toward the driven cam 176, such that the cam surfaces 172, 174 slidingly engage one another to lift the finish-form tool 134. Thus, the finish-form tool 134 moves independently of the motion of lower press platen 130. This independent motion of finish-form tool 134 takes the form of curvilinear motion and initiates a "second stage" operation of the subject tooling and forming process. Curvilinear motion means any motion along a curved path or an otherwise non-straight path.

In accord with another preferred aspect of the pre-forming stage of the present invention, the punch tool 134 may be used to mechanically impart a pre-form shape to the sheet metal blank 102. After the press is closed for pre-forming, the punch tool 134 may be pivoted from its lowered position toward its raised position so as to mechanically stretch the sheet metal blank 102 thereover and, if desired, into contact with the concave tool 110.

Figure 3:
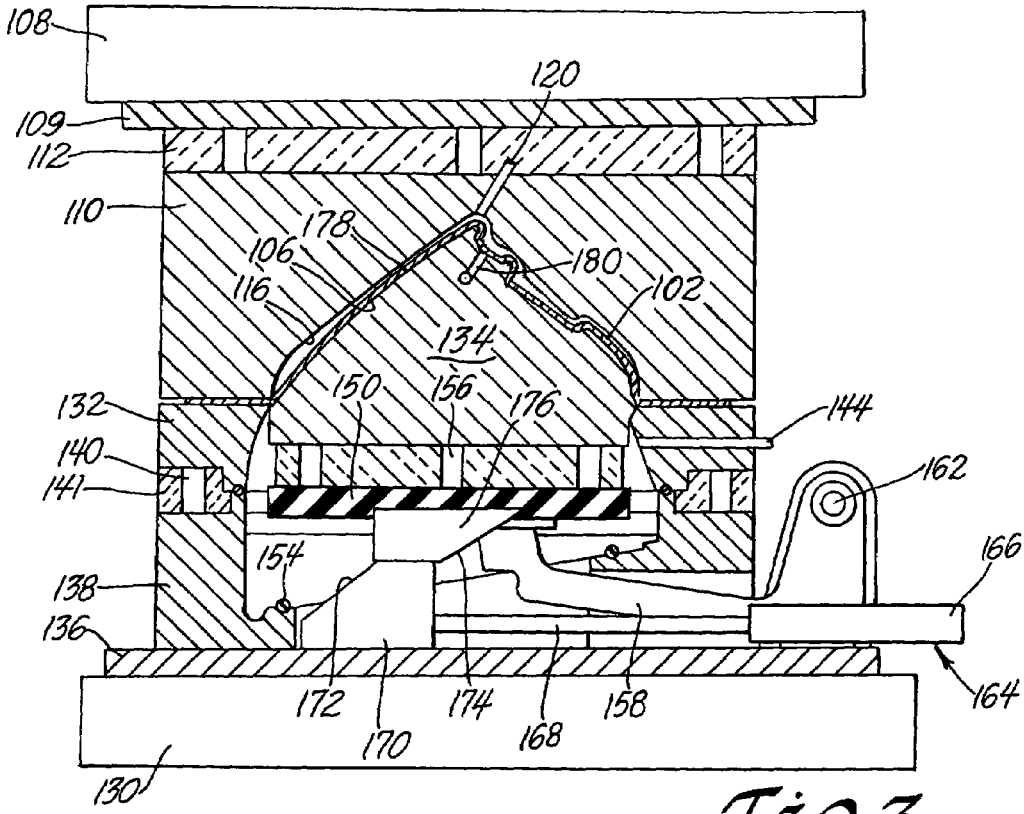
FIG. 3 is an elevational view in cross section of the press and tooling assembly of FIG. 2, wherein the finish-form tool has been pivoted into a second stage forming position and the sheet metal blank has been formed against the finish-form tool.

Referring now to FIG. 3, after sheet metal blank 102 has been subjected to the pre-form step as illustrated in FIG. 2, the working gas is vented from between the finish-form tool 134 surface and the sheet metal 102 through port 144, or other venting port, in the binder ring 132. Then, the internally heated punch tool 134 is raised for the final sheet metal forming step. In FIG. 3 it is seen that mounting plate 150 and finish-form tool 134 have been raised into closer proximity with the pre-form tool 110, such that the finish-form tool 134 is in a second stage closed position. As can be seen, the cylinder 166 has driven the piston 168 and drive cam 170 to a fully distal position such that the driven cam 176 is locked into position above the drive cam 170. As can also be seen, the swing arm 158 is pivoted to an upper position.

After the finish-form tool 134 is in forming position, gas pressure is introduced through the pre-form tool 110 through gas port 120. The sheet metal 102 is forced away from the forming surface 116 of the pre-form tool 110 and is stretched into contact with a finish forming surface 178 of the punch tool 134 as shown in FIG. 3. The finish forming surface 178 defines a predetermined finished part geometry or configuration for the finished blank 102. The back surface 106 of sheet metal blank 102 is now in full contact with the finish forming surface 178 of finish-form tool 134.

The temperature of the finish-form tool 134 is significantly lower than the temperature of pre-form tool 110. This lower temperature is possible because each tool is separately and internally heated. And, as described, each tool is insulated from the supporting press structure and, except for their opposing surfaces, they are insulated from each other. The lower temperature of this finish-form tool is suitable for lower strain rate finish shaping of the workpiece and to reduce the temperature of the sheet to facilitate prompt removal of the heat softened part from the tool when the press is opened.

Again, the air pressure is gradually increased in increments for finish-forming and within a short period of, e.g., 80 to 200 seconds the pre-formed sheet metal has been stretched against the surface of the punch tool 134 so that it assumes the final product configuration obtained in this tool/press assembly 100. An additional exhaust port 180 represents a manifold to supply an escape path for air trapped between the blank 102 and the tool 134. A multitude of small vent holes (not shown) are provided in the forming surface of the tool 134 and are formed in fluidic communication with the exhaust port 180. After the forming step, the air pressure is then released through gas port 120 or other suitable venting port.

Figure 4:
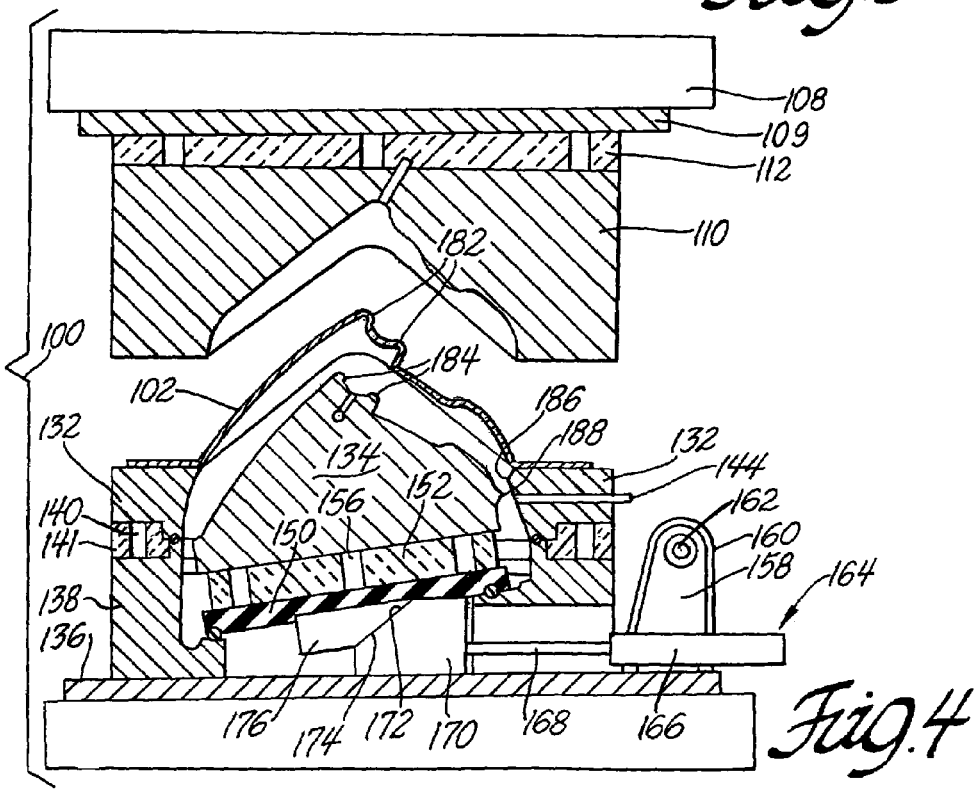
FIG. 4 is an elevational view in cross section of the press and tooling assembly of FIG. 3, wherein the pre-form tool has been raised and the finish-form tool has been pivotably retracted such that the now finished blank may be removed.

As shown in FIG. 4, the pre-form tool 110 may now be retracted by activation of the platen 108 for removal of the finish-formed blank 102 from the press. Before the finished blank 102 may be removed, however, the finish-form tool 134 must be pivotably retracted away therefrom. As shown in FIG. 4, the finished part 102 includes deep drawn portions 182 that were formed by projections 184 of the finish-form tool 134. Moreover, the binder ring 132 closely follows the contour of the finish-form tool 134 such that a projection 186 of the binder ring 132 fits closely with a projection 188 of the finish-form tool 134.

Vertical retraction of the finish-form tool 134 would thus be impossible with the part geometry and tool geometry shown in FIG. 4. Vertical retraction of the finish-form tool 134 would result in deformation of the deep drawn portions 182 of the finished blank 102 and interference of the finish-form tool 134 and the projections 186, 188 of the binder ring 132 and finish-form tool 134. Accordingly, the finish-form tool 134 must be pivoted out of second stage position as provided herein. The location of the pivot pin 162 is selected so as to enable pivotable clearance between the finish-form tool 134 and the binder ring 132. The finish-form tool 134 is pivoted out of position by retracting the piston 168 back into the cylinder 166 so as to retract the drive cam 170 away from the driven cam 176. Accordingly, the finish-form tool 134 pivotably descends in a controlled curvilinear motion by virtue of the swing arm 158 mounting arrangement.

The finish blank 102 is then removed and suitably cooled. Any trimming operations and the like are accomplished to finish the making of the part. The press is now in its open position and the tooling is ready for the insertion of a new blank 102 so that the process starts again to form the next part.

It should be understood that the invention is not limited to the embodiments that have been illustrated and described herein, but that various changes may be made without departing from the spirit and scope of the invention. For example, the practice of the present invention has been described in reference to hot stretch-forming an aluminum alloy AA5083 sheet metal blank into an automotive deck lid outer panel. However, the present invention is also applicable to conventional forming operations for producing a wide variety of sheet metal products. Moreover, it is contemplated that some part geometry may necessitate motion that is not strictly linear or strictly curved along a single radius. Rather, the present invention contemplates that the punch may be moved in a non-uniform motion in any combination of pivoting and linear retraction or compound curvilinear retraction. Accordingly, it is intended that the invention not be limited to the disclosed embodiments, but that it have the full scope permitted by the language of the following claims.

The invention claimed is:

1. A method of forming an article from a blank of sheet metal, said method being performed using opposing tools, said opposing tools comprising a finish-form tool having a finish-form surface defining a finish-form configuration for said article and a pre-form tool having a pre-form surface defining a pre-form configuration for said article, said method comprising:

placing said blank between said opposing tools, said blank having a first side surface facing said pre-form tool and a second side surface facing said finish-form tool;

moving said pre-form tool to a first stage closed position for pre-forming said blank into said pre-form configuration;

curvilinearly moving said finish-form tool to a second stage closed position for at least one of mechanically pre-forming said blank against said pre-form tool and hot-gas finish-forming said blank into said finish-form configuration; and curvilinearly retracting said finish-form tool.

2. A method as claimed in claim 1, wherein said step of curvilinearly moving said finish-form tool includes pivotably moving said finish-form tool.

3. A method as claimed in claim 2, wherein said step of pivotably moving said finish-form tool is accomplished by pivotably mounting said finish-form tool about a fixed pivot.

4. A method as claimed in claim 3, wherein said step of pivotably moving said finish-form tool is further accomplished by camming said finish-form tool in an upward direction about said fixed pivot.

5. A method of forming an article from a blank of sheet metal, said method being performed using opposing tools mounted between opposing platens of a press, said opposing tools comprising a finish-form tool having a finish-form surface defining a finish-form configuration for said article and a pre-form tool having a pre-form surface defining a pre-form configuration for said article, said method comprising:

placing said blank between said opposing tools, said blank having a first side surface facing said pre-form tool and a second side surface facing said finish-form tool;

linearly moving said pre-form tool to a first stage closed position;

applying working gas pressure to said second side surface of said blank to conform said first side surface of said blank against said pre-form surface of said pre-form tool to shape said blank into said pre-form configuration;

curvilinearly moving said finish-form tool to a second stage closed position;

applying working gas pressure to said first side surface of said blank to conform said second side surface of said blank against said finish-form surface of said finish-form tool to shape said blank into said finish-form configuration;

curvilinearly retracting said finish-form tool;

linearly retracting said pre-form tool; and removing said blank.

6. A method as claimed in claim 5, wherein said step of curvilinearly moving said finish-form tool includes pivotably moving said finish-form tool.

7. A method as claimed in claim 6, wherein said step of pivotably moving said finish-form tool is accomplished by pivotably mounting said finish-form tool about a fixed pivot.

8. A method as claimed in claim 7, wherein said step of pivotably moving said finish-form tool is further accomplished by camming said finish-form tool in an upward direction about said fixed pivot.

9. A method of forming an article from a blank of sheet metal, said method being performed using opposing tools mounted between opposing platens of a press, said opposing tools comprising a finish-form tool having a finish-form surface defining a finish-form configuration for said article and a pre-form tool having a pre-form surface defining a pre-form configuration for said article, said method comprising:

pre-heating said blank to a predetermined temperature for stretch elongation of said blank under pressure of a working gas;

placing said blank between said opposing tools, said blank having a first side surface facing said pre-form tool and a second side surface facing said finish-form tool;

vertically moving said pre-form tool to a first stage closed position;

applying working gas pressure to said second side surface of said blank to conform said first side surface of said blank against said pre-form surface of said pre-form tool to shape said blank into said pre-form configuration;

pivotably moving said finish-form tool to a second stage closed position;

applying working gas pressure to said first side surface of said blank to conform said second side surface of said blank against said finish-form surface of said finish-form tool to shape said blank into said finish-form configuration;

pivotably retracting said finish-form tool;

vertically retracting said pre-form tool; and removing said blank.

10. A method as claimed in claim 9, wherein said step of pivotably moving said finish-form tool is accomplished by pivotably mounting said finish-form tool about a fixed pivot.

11. A method as claimed in claim 10, wherein said step of pivotably moving said finish-form tool is further accomplished by camming said finish-form tool in an upward direction about said fixed pivot.

* * * * *